US008971558B2

(12) United States Patent
Lunner

(10) Patent No.: US 8,971,558 B2
(45) Date of Patent: Mar. 3, 2015

(54) HEARING DEVICE WITH EXTERNAL ELECTRODE

(71) Applicant: Oticon A/S, Smørum (DK)

(72) Inventor: Thomas Lunner, Smørum (DK)

(73) Assignee: Oticon A/S, Smorum (DK)

( * ) Notice: Subject to any disclaimer, the term of this patent is extended or adjusted under 35 U.S.C. 154(b) by 0 days.

(21) Appl. No.: 13/896,135

(22) Filed: May 16, 2013

(65) Prior Publication Data

US 2013/0315425 A1 Nov. 28, 2013

Related U.S. Application Data

(60) Provisional application No. 61/651,018, filed on May 24, 2012.

(30) Foreign Application Priority Data

May 24, 2012 (EP) ..... 12169274

(51) Int. Cl.
*H04R 25/00* (2006.01)

(52) U.S. Cl.
CPC ..... *H04R 25/60* (2013.01); *H04R 25/00* (2013.01); *H04R 25/65* (2013.01); *H04R 2225/31* (2013.01); *H04R 2225/61* (2013.01); *H04R 25/43* (2013.01)
USPC ..... 381/323; 381/322; 381/324; 381/312; 381/328; 600/379

(58) Field of Classification Search
CPC ..... H04R 25/00; H04R 25/02; H04R 25/407; H04R 25/43; H04R 25/50; H04R 25/505; H04R 25/55; H04R 25/60; H04R 2225/00; H04R 2225/31; H04R 2225/33; H04R 2225/43; H04R 2225/61
USPC ..... 381/312, 314, 322–324, 328; 600/379, 600/544, 301
See application file for complete search history.

(56) References Cited

U.S. PATENT DOCUMENTS 4,679,240 A 7/1987 Heide
2004/0138723 A1 7/2004 Malick et al.

(Continued)

FOREIGN PATENT DOCUMENTS

DE 10232376 A 2/2004
EP 2200347 A2 6/2010

(Continued)

*Primary Examiner* — Ahmad F Matar
*Assistant Examiner* — Sabrina Diaz
(74) *Attorney, Agent, or Firm* — Birch, Stewart, Kolasch & Birch, LLP

(57) ABSTRACT

A hearing device has a housing and a first electrode arranged to abut the skin of the individual. The hearing device further comprises at least two different elements selected from the group comprising: a brain-wave measurement circuit receiving measurement signals from the first electrode and from a second electrode arranged to abut the skin of the individual; a communication circuit receiving communication signals from and/or transmitting communication signals to the first electrode; a touch-sensing circuit transmitting sensing signals to the first electrode; a thermoelectric generator thermally connected to the outer surface of the housing mainly through the first electrode; and a charge control circuit sinking a charging current in dependence on a voltage across the first electrode and a third electrode.

19 Claims, 1 Drawing Sheet

(56) References Cited

U.S. PATENT DOCUMENTS

| | | | | |
|---|---|---|---|---|
| 2005/0256320 | A1 | 11/2005 | Luinstra et al. | |
| 2006/0169314 | A1* | 8/2006 | Horio et al. | 136/205 |
| 2007/0071262 | A1 | 3/2007 | Rass | |
| 2009/0209303 | A1 | 8/2009 | Kroll et al. | |
| 2009/0254149 | A1 | 10/2009 | Polak | |
| 2011/0091059 | A1* | 4/2011 | Sacha | 381/321 |
| 2011/0098112 | A1* | 4/2011 | LeBoeuf et al. | 463/31 |
| 2011/0143211 | A1* | 6/2011 | Takeyama | 429/302 |
| 2012/0177233 | A1* | 7/2012 | Kidmose et al. | 381/314 |
| 2013/0085359 | A1* | 4/2013 | Yao et al. | 600/372 |

FOREIGN PATENT DOCUMENTS

| | | | |
|---|---|---|---|
| ES | 2299731 | T3 | 6/2006 |
| WO | WO 2011/006681 | A1 | 1/2011 |

* cited by examiner

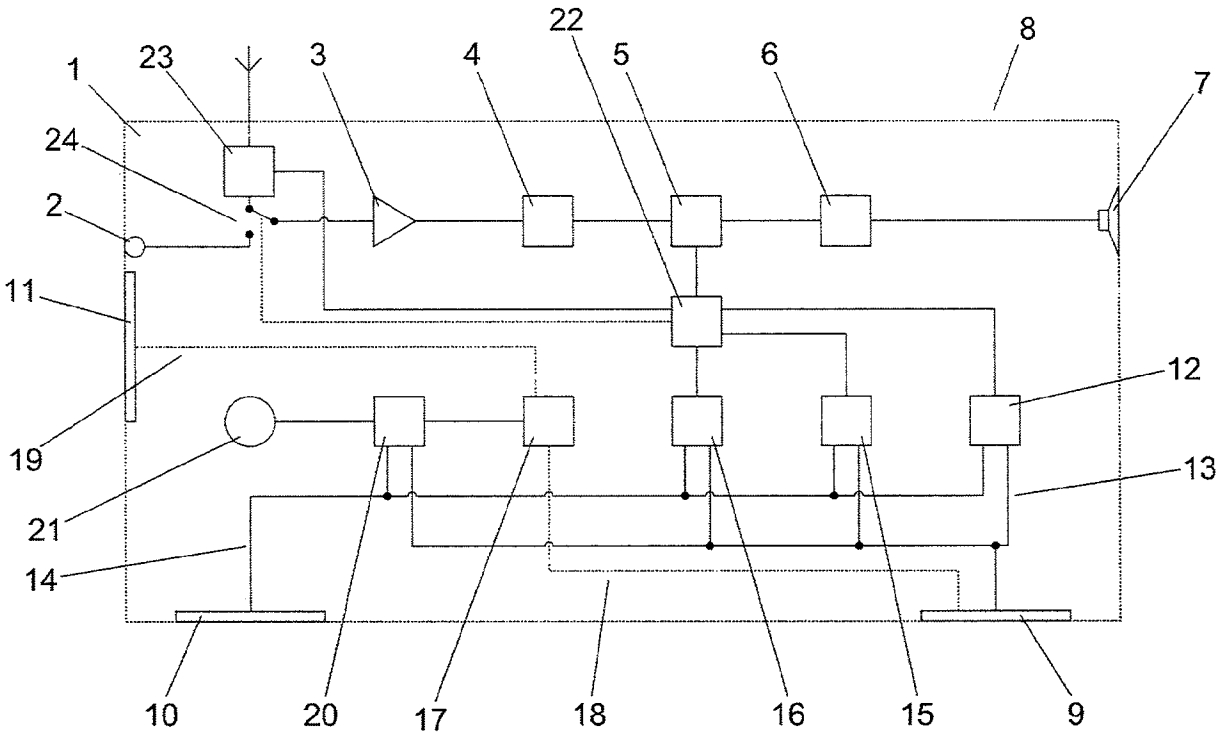
7
8
6
5
22
4
3
23
1
24
2
11
19
21
14
10
20
17
18
16
15
9
13
12

HEARING DEVICE WITH EXTERNAL ELECTRODE

TECHNICAL FIELD

The present invention relates to a hearing device with one or more external electrodes. More specifically, the present invention relates to a hearing device such as e.g. a hearing aid, a listening device, an earphone or a headset, which has one or more electrodes intended to be in contact with the skin of a user of the hearing device.

The invention may e.g. be useful in applications such as a hearing aid for compensating for a hearing-impaired person's loss of hearing capability, a listening device for augmenting a normal-hearing person's hearing capability, an earphone for conveying electronic audio signals to the user or a headset for communicating with another person.

BACKGROUND ART

US patent application 2009/0209303 A1 discloses a wireless headset with a thermoelectric device, a regulator and an energy storage element, e.g. a rechargeable battery. One side of the thermoelectric device is thermally connected through thermally conductive material, e.g. a high density conductive polymer, to the user's body and is thus subjected to a temperature close to the temperature of the user's skin, whereas the other side is thermally connected through thermally conductive material to solar cells subjected to ambient temperature. The thermoelectric device converts a temperature difference between the user's skin and the solar cells into an electric current, which is supplied to the energy storage element through the regulator in order to provide power for operation of the wireless headset.

The thermally conductive material occupies a relatively large portion of the outside surface of the wireless headset.

German patent application DE 10 232 376 A discloses a thermoelectric element and the use of it for powering a hearing aid. The thermoelectric element comprises a stack of electrically conductive and electrically insulating layers, and the electrically conductive layers may comprise an electrically conductive polymer.

European patent application EP 2 200 347 A2 discloses a hearing aid having electrodes for measuring an electroencephalogram (EEG). The electrodes may be manufactured in the surface of a hearing aid shell. The hearing aid may further have a thermo element for measuring the body temperature of the hearing-aid user and being located where the hearing aid meets the skin surface.

European patent application EP 2 299 731 A1 discloses a listening device wherein charging pads for charging a rechargeable battery are arranged on a housing portion intended for placement in the ear canal during use of the listening device.

The electrodes and charging pads disclosed in the above mentioned prior art also occupy significant portions of the outside surfaces of the respective device housings.

DISCLOSURE OF INVENTION

Devices intended for placement at the ear, in the ear or in the ear canal of an individual, i.e. a user, generally have a relatively small surface area, which limits the number, the size and the freedom for placement of thermally conductive areas, electrodes and/or charging pads such a device may have. This makes it difficult to combine functions requiring such thermally conductive areas, electrodes and/or charging pads in one and the same device.

It is an object of the present invention to provide a device, which does not suffer from the above problem.

This and other objects of the invention are achieved by the invention defined in the accompanying independent claims and as explained in the following description. Further objects of the invention are achieved by the embodiments defined in the dependent claims and in the detailed description of the invention.

By sharing electrically and/or thermally conductive surface portions between different functional elements of a hearing device, the required surface area may be reduced and/or the surface portions may be placed with increased freedom.

In the present context, a "hearing device" refers to a device, such as e.g. a hearing aid, a listening device or an active ear-protection device, which is adapted to improve, augment and/or protect the hearing capability of a user by receiving acoustic signals from the user's surroundings, generating corresponding audio signals, possibly modifying the audio signals and providing the possibly modified audio signals as audible signals to at least one of the user's ears. A "hearing device" further refers to a device such as an earphone or a headset adapted to receive audio signals electronically, possibly modifying the audio signals and providing the possibly modified audio signals as audible signals to at least one of the user's ears. Such audible signals may e.g. be provided in the form of acoustic signals radiated into the user's outer ears, acoustic signals transferred as mechanical vibrations to the user's inner ears through the bone structure of the user's head and/or electric signals transferred directly or indirectly to the cochlear nerve of the user. The hearing device may be configured to be worn in any known way, e.g. as a unit arranged behind the ear with a tube leading radiated acoustic signals into the ear canal or with a loudspeaker arranged close to or in the ear canal, as a unit entirely or partly arranged in the pinna and/or in the ear canal, as a unit attached to a fixture implanted into the skull bone, etc. More generally, a hearing device comprises an input transducer for receiving an acoustic signal from an user's surroundings and providing a corresponding input audio signal and/or a receiver for electronically receiving an input audio signal, a signal processing circuit for processing the input audio signal and an output transducer for providing an audible signal to the user in dependence on the processed audio signal. In some hearing devices, an amplifier may constitute the signal processing circuit.

A "hearing system" refers to a system comprising one or two hearing devices, and a "binaural hearing system" refers to a system comprising one or two hearing devices and being adapted to cooperatively provide audible signals to both of the user's ears. Hearing systems or binaural hearing systems may further comprise "auxiliary devices", which communicate with the hearing devices and affect and/or benefit from the function of the hearing devices. Auxiliary devices may be e.g. remote controls, audio gateway devices, mobile phones, public-address systems, car audio systems or music players. Hearing devices, hearing systems or binaural hearing systems may e.g. be used for compensating for a hearing-impaired person's loss of hearing capability, augmenting or protecting a normal-hearing person's hearing capability and/or conveying electronic audio signals to a person.

As used herein, the singular forms "a", "an", and "the" are intended to include the plural forms as well (i.e. to have the meaning "at least one"), unless expressly stated otherwise. It will be further understood that the terms "has", "includes", "comprises", "having", "including" and/or "comprising", when used in this specification, specify the presence of stated features, integers, steps, operations, elements and/or components, but do not preclude the presence or addition of one or more other features, integers, steps, operations, elements, components and/or groups thereof. It will be understood that when an element is referred to as being "connected" or "coupled" to another element, it can be directly connected or coupled to the other element, or intervening elements may be present, unless expressly stated otherwise. As used herein, the term "and/or" includes any and all combinations of one or more of the associated listed items. The steps of any method disclosed herein do not have to be performed in the exact order disclosed, unless expressly stated otherwise.

BRIEF DESCRIPTION OF THE DRAWINGS

The invention will be explained in more detail below in connection with preferred embodiments and with reference to the drawings in which:

FIG. 1 shows an embodiment of a hearing device according to the invention.

The FIGURE is schematic and simplified for clarity, and it just shows details, which are essential to the understanding of the invention, while other details are left out. Throughout, like reference numerals and/or names are used for identical or corresponding parts.

Further scope of applicability of the present invention will become apparent from the detailed description given hereinafter. However, it should be understood that the detailed description and specific examples, while indicating preferred embodiments of the invention, are given by way of illustration only, since various changes and modifications within the scope of the invention will become apparent to those skilled in the art from this detailed description.

MODE(S) FOR CARRYING OUT THE INVENTION

The hearing device 1 shown in FIG. 1 comprises a microphone 2, a preamplifier 3, a digitiser 4, a signal processor 5, a power amplifier 6 and a loudspeaker 7 constituting an audio signal path. The hearing device 1 further comprises a housing 8, which is adapted to be arranged in an operating position at an ear, in an ear or in an ear canal of a user of the hearing device 1. The microphone 2 is arranged to receive an acoustic input signal from the user's surroundings and provide a corresponding microphone signal to the preamplifier 3. The preamplifier 3 is adapted to amplify the microphone signal and provide the amplified microphone signal to the digitiser 4. The digitiser 4 is adapted to digitise the amplified microphone signal and provide a digitised audio signal to the signal processor 5, which is adapted to modify the digitised audio signal in accordance with the purpose of the hearing device 1, e.g. to improve or augment the hearing capability of the user and/or to amplify or convey a received audio signal to the user. The signal processor 5 is adapted to provide the modified audio signal to the power amplifier 6, which may e.g. comprise a pulse-width modulator, which is adapted to provide a corresponding amplified and/or pulse-width modulated signal to the loudspeaker 7. The loudspeaker 7 is arranged to transmit an acoustic output signal corresponding to the amplified and/or pulse-width modulated signal to the user.

The hearing device 1 further comprises a first and a second electrode 9, 10, which each constitute an outer surface portion of the housing 8. The electrodes are separate from each other and are arranged such that they each abut the user's skin when the housing 8 is in the operating position. The electrodes 9, 10 are preferably arranged such that the length of the electric connection between the electrodes 9, 10 through the user's skin is as large as possible with the given housing 8 in the operating position. The electrodes 9, 10 may e.g. be arranged at opposite sides of the housing 8, and/or, in the case of an elongate housing 8, at opposite ends of the housing 8. The hearing device 1 further comprises a thermally conductive body 11, which constitutes a further outer surface portion of the housing 8 and which is arranged such that it is subjected to ambient temperature when the housing 8 is in the operating position. The thermally conductive body 11 is preferably arranged at the same end or side of the housing 8 at which the microphone 2 or a sound inlet to the microphone 2 is arranged.

The hearing device 1 further comprises a brain-wave measurement circuit 12 that is electrically connected to receive measurement signals from the first electrode 9 via a first electric connection 13 and from the second electrode 10 via a second electric connection 14. The brain-wave measurement circuit 12 is adapted to determine and provide brain-wave signals comprising e.g. electroencephalograms (EEG) and/or auditory brainstem responses (ABR) in dependence on the measurement signals. The brain-wave measurement circuit 12 may comprise preamplifiers (not shown) adapted to amplify measurement signals.

The hearing device 1 further comprises a communication circuit 15 that is electrically connected to receive and transmit communication signals from/to the first electrode 9 via the first electric connection 13 and from/to the second electrode 10 via the second electric connection 14. The communication circuit 15 is adapted to determine and provide receive data in dependence on received communication signals and to transmit communication signals in dependence on transmit data provided to the communication circuit 15. The communication signals are preferably capacitively or conductively coupled to the user's skin such that they may pass through the user's body, e.g. to/from a second hearing device arranged at the user's other ear and/or to/from a further device arranged on the user's body. In some embodiments, the communication circuit 15 is not electrically connected to a second electrode 10, in which case the second electrode 10 and the second electric connection 14 may be omitted.

The hearing device 1 further comprises a touch-sensing circuit 16 that is electrically connected to transmit sensing signals to the first electrode 9 via the first electric connection 13 and to the second electrode 10 via the second electric connection 14. The touch-sensing circuit 16 is adapted to determine variations in the sensing signals, to determine and/or classify touch events in dependence on the determined variations and to provide corresponding touch event signals in dependence on the determined and/or classified touch events. In some embodiments, the touch-sensing circuit 16 is not electrically connected to a second electrode 10, in which case the second electrode 10 and the second electric connection 14 may be omitted. The touch-sensing circuit 16 may transmit sensing signals at multiple frequencies and determine and/or classify touch events in dependence on the relationship between determined variations in the sensing signals at different frequencies.

The hearing device 1 further comprises a thermoelectric generator 17 having a first thermally responsive surface that is thermally connected to the outer surface of the housing 8 mainly through a first thermal connection 18 via the first electrode 9 and a second thermally responsive surface that is thermally connected to the outer surface of the housing 8 mainly through a second thermal connection 19 via the thermally conductive body 11. The thermoelectric generator 17 is adapted to provide a first charging current when the first and the second thermally responsive surfaces are subjected to different temperatures. The thermoelectric generator 17 may have a relatively flat shape with the thermally responsive surfaces arranged at opposite sides. The thermoelectric generator 17 may comprise one or more thermoelectric generator cells (not shown) each being adapted to convert a temperature difference into an electric voltage according to the so-called Seebeck effect. In the case that the thermoelectric generator 17 comprises more than one thermoelectric generator cell, such as e.g. about 10, about 100 or about 500 cells, the cells are preferably connected in parallel with respect to the temperature exposure. The cells may thus e.g. be arranged as a two-dimensional array having two larger surfaces that constitute the respective thermally responsive surfaces of the thermoelectric generator 17. The array may preferably be curved in the third dimension in order to allow arrangement on a non-planar surface on or in the hearing device 1. Electrically, the cells may be connected in parallel, in series or in any combination hereof, depending on the desired output voltage and/or output current.

The hearing device 1 further comprises a charge control circuit 20 and a rechargeable battery 21, which is connected to supply power to the electronic circuits of the hearing device 1. The charge control circuit 20 is connected to the first electrode 9 via the first electric connection 13 and to the second electrode 10 via the second electric connection 14. The charge control circuit 20 is adapted to sink a second charging current when a charging voltage is applied across the electrodes 9, 10 and to convert the first and/or the second charging current into a third charging current and provide the third charging current to the rechargeable battery 21. The first and second electrodes 9, 10 thus serve as charging pads. In some embodiments, the charge control circuit 20 is not connected to an electrode 9, 10, in which case the second electrode 10 and the second electric connection 14 may be omitted. In this case, a power converter, which is adapted to modify the voltage of the electric power output from the thermoelectric generator 17, may replace the charge control circuit 20. In some embodiments, the hearing device 1 comprises a capacitive energy storage, e.g. a capacitor, or another type of rechargeable power storage instead of the rechargeable battery 21.

The brain-wave measurement circuit 12, the communication circuit 15, the touch-sensing circuit 16 and/or the thermoelectric generator 17 may comprise protection circuits (not shown) adapted to protect the respective circuits 12, 15, 16, 17 against possible damage caused e.g. by a charging voltage applied to the first and/or second electrodes 9, 10 and/or by voltages received and/or provided by the respective other ones of the circuits 12, 15, 16, 17.

The hearing device 1 further comprises a control unit 22, which is connected to receive the brain-wave signals from the brain-wave measurement circuit 12, the receive data from the communication circuit 15 and the touch event signals from the touch-sensing circuit 16. The control unit 22 is further connected to provide the transmit data to the communication circuit 15 as well as to receive and provide various data, such as e.g. audio signals, status information, settings and commands, from/to the signal processor 5. The control unit 22 is adapted to control the signal processing in the signal processor 5 in dependence on the brain-wave signals, the receive data and/or the touch event signals, as well as to provide the transmit data in dependence on the brain-wave signals, the receive data, the touch event signals and/or data received from the signal processor 5. The control unit 22 may e.g. be adapted to compare the brain wave signals to predetermined patterns in order to estimate or classify the user's state and/or physical actions. The control unit 22 may further be adapted to combine information in the brain-wave signals with information in the touch event signals in order to increase the reliability of the determination of touch events, e.g. by comparing or otherwise deriving a measure of correlation between the respective signals. Thus, determined touch events may be used for remote control of the hearing device 1.

The signal processor 5 is adapted to adjust its modification of the digitised audio signal in response to information comprised in the data received from the control unit 22 and/or to provide the modified audio signal in dependence on an audio signal comprised in these data. This allows the hearing device 1 to change its audio signal processing in response to e.g. commands, status information and/or audio signals received from a remote device, and/or to include such audio signals in the acoustic signal transmitted by the loudspeaker 7. The remote device could e.g. be a remote control, a second hearing device located at or in the respective other ear of the user or an auxiliary device, e.g. a so-called audio gateway device, adapted to transmit an audio signal from an external device, such as e.g. a mobile phone or a TV set, to the hearing device 1. The hearing device 1 may thus be part of a binaural hearing system.

The hearing device 1 may comprise a wireless transceiver 23 for receiving and transmitting wireless communication signals, such as e.g. inductive, radio-frequency (RF) or optical signals. The wireless transceiver 23 may be adapted to receive a wireless signal from a further device and to provide the audio input signal to the preamplifier 3 in dependence on the received wireless signal. The hearing device 1 may comprise switching means 24 for switching between receiving the audio input signal from the wireless transceiver 23 and receiving the audio input signal from the microphone 2. The wireless transceiver 23 may perform any combination of the functions described above for the communication circuit 15 and may thus partly or completely replace and/or augment the communication circuit 15. In some embodiments, a wireless receiver may replace the wireless transceiver 23. In an embodiment, the communication circuit 15 is adapted to provide the input audio signal in dependence on a wireless signal received from a further device via the first and/or the second electrode 9, 10 and thus constitutes the wireless receiver 23.

The brain-wave measurement circuit 12, the communication circuit 15, the touch-sensing circuit 16, the thermoelectric generator 17 and the charge control circuit 20 each constitute an element of a group. In an embodiment, the hearing device 1 comprises two different elements, i.e.:

- the brain-wave measurement circuit 12 and the communication circuit 15;
- the brain-wave measurement circuit 12 and the touch-sensing circuit 16;
- the brain-wave measurement circuit 12 and the thermoelectric generator 17;
- the brain-wave measurement circuit 12 and the charge control circuit 20;
- the communication circuit 15 and the touch-sensing circuit 16;
- the communication circuit 15 and the thermoelectric generator 17;
- the communication circuit 15 and the charge control circuit 20;
- the touch-sensing circuit 16 and the thermoelectric generator 17;
- the touch-sensing circuit 16 and the charge control circuit 20; or
- the thermoelectric generator 17 and the charge control circuit 20.

In another embodiment, the hearing device 1 comprises three different elements 12, 15, 16, 17, 20. In a further embodiment, the hearing device 1 comprises four different elements 12, 15, 16, 17, 20. In any embodiment, two or more separate electrodes may replace the second electrode 10, in which case each of such separate electrodes may instead of the second electrode 10 be connected to one or more of the comprised elements. In the extreme case, each of the elements 12, 15, 16, 20 may be connected to different ones of such separate electrodes. Any or all of such separate electrodes, the first electrode 9, the second electrode 10, the thermally conductive body 11, the first thermal connection 18 and the second thermal connection 19 may comprise an electrically conductive polymer, thus allowing it/them to be resilient. Any or all of such separate electrodes, the first electrode 9, the second electrode 10 and the thermally conductive body 11 may be covered by a material comprising graphene, or alternatively by a material comprising carbon and titanium, in order to achieve a biocompatible surface.

The signal processor 5, the communication circuit 15 and the control unit 22 are preferably implemented mainly as digital circuits operating in the discrete time domain, but any or all portions hereof may alternatively be implemented as analog circuits operating in the continuous time domain. The same applies to such portions of the brain-wave measurement circuit 12, the touch-sensing circuit 16, the thermoelectric generator 17 and the charge control circuit 20 that may be implemented digitally. Such digital circuits may be implemented in any suitable combination of hardware, firmware and software and/or in any suitable combination of hardware units. Furthermore, any single hardware unit may execute the operations of several functional blocks in parallel or in interleaved sequence and/or in any suitable combination thereof.

Further modifications obvious to the skilled person may be made to the disclosed method, system and/or device without deviating from the scope of the invention. Within this description, any such modifications are mentioned in a non-limiting way. The possible modifications below are mentioned as examples hereof.

Some preferred embodiments have been described in the foregoing, but it should be stressed that the invention is not limited to these, but may be embodied in other ways within the subject-matter defined in the following claims. For example, the features of the described embodiments may be combined arbitrarily, e.g. in order to adapt the system, the devices and/or the method according to the invention to specific requirements.

It is further intended that the structural features of the system and/or devices described above, in the detailed description of 'mode(s) for carrying out the invention' and in the claims can be combined with the methods, when appropriately substituted by a corresponding process. Embodiments of the methods have the same advantages as the corresponding systems and/or devices.

Any reference numerals and names in the claims are intended to be non-limiting for their scope.

The invention claimed is:

1. A hearing device adapted to be worn by an individual and comprising:

an input unit providing an input audio signal;

a signal processing circuit for processing the input audio signal;

an output transducer for providing an audible signal to the individual in dependence on the processed audio signal;

a housing adapted to be arranged in an operating position at an ear, in an ear or in an ear canal of the individual;

a first electrode constituting an outer surface portion of the housing and arranged such that an outer surface of the first electrode abuts the skin of the individual when the housing is in the operating position;

a brain-wave measurement circuit electrically connected to receive measurement signals from the first electrode and from a second electrode, the second electrode being separate from the first electrode, the second electrode constituting a further outer surface portion of the housing and further being arranged such that the second electrode abuts the skin of the individual when the housing is in the operating position; and a thermoelectric generator having a first and a second thermally responsive surface, the first thermally responsive surface being thermally connected to the outer surface of the housing mainly through the first electrode, wherein the first electrode is configured to provide an electrically conductive surface for the brain-wave measurement circuit and a thermally responsive surface for the thermoelectric generator.

2. A hearing device according to claim 1, wherein the input unit comprises an input transducer arranged to receive an acoustic signal from the individual's surroundings and adapted to provide the input audio signal in dependence on the acoustic signal.

3. A hearing device according to claim 1, wherein the input means unit comprises a wireless receiver adapted to provide the input audio signal in dependence on a wireless signal received from a further device.

4. A hearing device according to claim 3, further comprising:

a communication circuit electrically connected to receive communication signals from and/or transmit communication signals to the first electrode, wherein the communication circuit constitutes the wireless receiver.

5. A hearing device according to claim 4, wherein the communication circuit further is electrically connected to receive communication signals from and/or transmit communication signals to a fourth electrode separate from the first electrode and constituting a further outer surface portion of the housing.

6. A hearing device according to claim 1, wherein a touch-sensing circuit is electrically connected to transmit sensing signals to a fifth electrode separate from the first electrode and constituting a further outer surface portion of the housing.

7. A hearing device according to claim 1, wherein the second thermally responsive surface of the thermoelectric generator is thermally connected mainly through a thermally conductive body constituting a further outer surface portion of the housing and arranged such that it is subjected to ambient temperature when the housing is in the operating position.

8. A hearing device according to claim 1, and further comprising a power converter adapted to modify the voltage of the electric power output from the thermoelectric generator.

9. A hearing device according to claim 8, and further comprising a rechargeable power storage connected to receive electric power from the thermoelectric generator, the power converter and/or a charge control circuit.

10. A hearing device according to claim 9, wherein the charge control circuit constitutes the power converter.

11. A hearing device according to claim 1, further comprising:

a third, a fourth, and a fifth electrode separate from each other and the first electrode and constituting a further outer surface portion of the housing, wherein at least one of the third, the fourth and the fifth electrode is arranged such that it abuts the skin of the individual when the housing is in the operating position.

12. A hearing device according to claim 11, wherein at least one of the second, the third, the fourth and the fifth electrode and a thermally conductive body, constituting a further outer surface portion of the housing and arranged such that the thermally conductive body is subjected to ambient temperature when the housing is in the operating position, is electrically and/or thermally connected to said brain-wave measurement circuit and said thermoelectric generator.

13. A hearing device according to claim 11, wherein at least one of the first, the second, the third, the fourth and the fifth electrode and a thermally conductive body, constituting a further outer surface portion of the housing and arranged such that the thermally conductive body is subjected to ambient temperature when the housing is in the operating position, comprises an electrically conductive polymer.

14. A hearing device according to claim 11, wherein the outer surface of at least one of the first, the second, the third, the fourth and the fifth electrode and a thermally conductive body, constituting a further outer surface portion of the housing and arranged such that the thermally conductive body is subjected to ambient temperature when the housing is in the operating position, is covered by a material comprising graphene.

15. A hearing device according to claim 11, wherein the outer surface of at least one of the first, the second, the third, the fourth and the fifth electrode and a thermally conductive body, constituting a further outer surface portion of the housing and arranged such that the thermally conductive body is subjected to ambient temperature when the housing is in the operating position, is covered by a material comprising carbon and titanium.

16. A hearing device according to claim 2, wherein the input unit comprises a wireless receiver adapted to provide the input audio signal in dependence on a wireless signal received from a further device.

17. A hearing device according to claim 2, further comprising:

a communication circuit electrically connected to receive communication signals from and/or transmit communication signals to the first electrode, wherein the communication circuit further is electrically connected to receive communication signals from and/or transmit communication signals to a fourth electrode separate from the first electrode and constituting a further outer surface portion of the housing.

18. A hearing device according to claim 2, wherein a touch-sensing circuit is electrically connected to transmit sensing signals to a fifth electrode separate from the first electrode and constituting a further outer surface portion of the housing.

19. The hearing device according to claim 1, further comprising at least one element from a group consisting of:

a communication circuit electrically connected to receive communication signals from and/or transmit communication signals to the first electrode;

a touch-sensing circuit electrically connected to transmit sensing signals to the first electrode; and a charge control circuit electrically connected to sink a charging current in dependence on a voltage applied between the first electrode and a third electrode separate from the first electrode.

* * * * *